United States Patent [19]

Apostolou et al.

[11] Patent Number: 4,732,209

[45] Date of Patent: Mar. 22, 1988

[54] PROCESS AND APPARATUS FOR TOP-FEED CASTING OF METALS

[75] Inventors: Georges Apostolou, Saint Nicolas; Sotiris Armaos, Saint-Nicolas, both of Greece

[73] Assignee: Aluminium Pechiney, Paris, France

[21] Appl. No.: 889,628

[22] Filed: Jul. 28, 1986

[30] Foreign Application Priority Data

Jul. 30, 1985 [FR] France ..... 85 12054
Jun. 6, 1986 [FR] France ..... 86 08427

[51] Int. Cl.[4] ..... B22D 11/04; B22D 11/124

[52] U.S. Cl. ..... 164/475; 164/342; 164/415; 164/444; 164/485; 164/487

[58] Field of Search ..... 164/487, 485, 475, 415, 164/435, 444, 342

[56] References Cited

U.S. PATENT DOCUMENTS 3,381,741 5/1968 Gardner ..... 164/472
4,157,728 6/1979 Mitamura et al. ..... 164/472 X
4,307,772 12/1981 Haller ..... 164/487 X
4,355,679 10/1982 Wilkins ..... 164/487 X
4,597,432 7/1986 Collins et al. ..... 164/487 X
4,598,763 7/1986 Wagstaff et al. ..... 164/487 X

FOREIGN PATENT DOCUMENTS 1364776 5/1964 France .

*Primary Examiner*—Nicholas P. Godici
*Assistant Examiner*—J. Reed Batten, Jr.
*Attorney, Agent, or Firm*—Dennison, Meserole, Pollack & Scheiner

[57] ABSTRACT

Metals are continuously cast in an ingot mould having a feeder head disposed thereabove. An isolating ring disposed around the lower portion of the feeder head forms an annular chamber which is maintained under an inert gas pressure throughout the duration of the casting operation by a conduit which is in communication with a source of inert gas.

4 Claims, 3 Drawing Figures

PROCESS AND APPARATUS FOR TOP-FEED CASTING OF METALS

Figure 1:
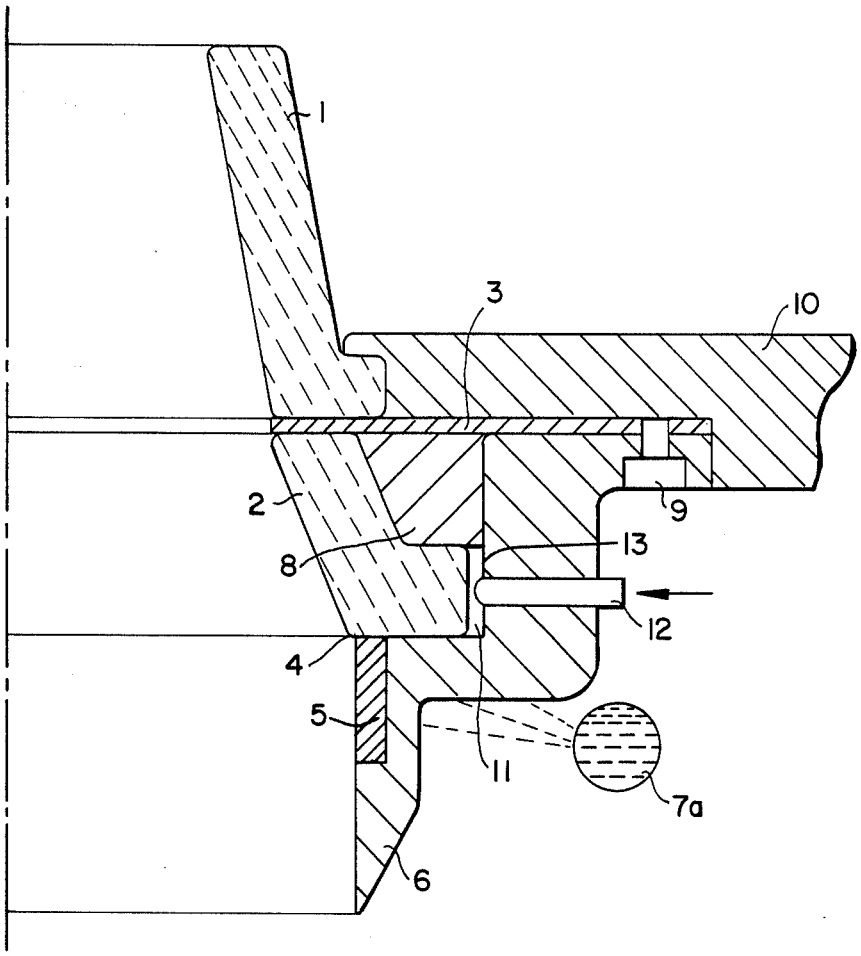

The invention relates to a process and an apparatus for top-feed casting of metals and in particular billets of aluminium or one of the alloys thereof.

The man skilled in the art is well aware of the process for the continuous casting of metals, in which a molten metal is introduced into an externally cooled ingot mould provided with a movable bottom. During its residence time in the ingot mould, the metal solidifies in contact with the wall of the mould and can be drawn downwardly by means of the movable bottom while the mould is supplied with molten metal in the upper part thereof so as to maintain an approximately constant level.

In order to remedy certain difficulties, a number of improvements have been made in that procedure, such as those which are taught for example in French Pat. No. 1,364,776 and which involve positioning a reserve of liquid metal above the ingot mould in order to ensure that the impurities or oxides which float to the free surface of the metal are not entrained in the resulting product where they would give rise to serious defects.

Consequently, that reserve which is also referred to as the feeder head or the "HOT-TOP", to use the English term, has been found to be an attractive proposition in the search for a good surface condition in particular on billets. Moreover, the processes which involve using a hot-top have been the subject of particular development in the case of multiple-gate casting operations in which, with a single level control, they make it possible to carry out casting in several tens of ingot moulds at a time.

Generally, the feeder head is disposed in overhanging relationship on the inside wall of the ingot mould and means for injecting gas or lubricant on a continuous basis are used. That can be seen from the teachings set forth in the following patents:

U.S. Pat. No. 3,381,741 in which the feed reservoir and the ingot mould are connected by way of a relatively thin heat-conducting insert and in which means for introducing lubricant within the ingot mould are disposed between the insert and the ingot mould:

U.S. Pat. No. 4,157,728 which comprises introducing a gas directly below the overhanging component and applying a gas pressure to the periphery of the metal which is positioned directly below the overhanging component, wherein a lubricating surface is produced within the ingot mould by the introduction of a lubricant just below the means for introducing the gas;

French Pat. No. 2,534,832 which comprises feeding a flow of gas under pressure at a point disposed outside the cavity of a mould, discharging the gas into the cavity at a point disposed on the periphery thereof and interposing means such as a graphite ring between the feed point and the discharge point on the outside of the cavity, to convert the flow of gas into a ring of fluid which extends around the metal mass at the periphery of the cavity. In addition, lubricating oil is passed into the casting ladle, preferably passing by way of the part in overhanging relationship, which is at the top of the ladle.

The applicants, taking an interest in the problem of casting metals using the HOT-TOP process and in particular casting billets of aluminium or aluminium alloy, thus found that on the one hand most of such processes require continuous lubrication and on the other hand the processes which involve using gases under pressure always inject that gas at the location of the ingot mould and have recourse to sophisticated control systems in order to maintain a pressure which is not excessively high in order not to give rise to movement within the liquid metal.

Being aware of the constraints imposed by such processes, the applicants' aim was to develop a simpler process which does not require lubrication, employing a gas injection system which is easier to control and by means of which it is possible to obtain products which have a good surface condition.

The process according to the invention therefore comprises casting the metal in an ingot mould having a movable bottom and internally provided with a graphite ring, which is externally cooled, the wall thereof which is in contact with the metal being initially lubricated, in which process:

the molten metal is stored in a feeder head comprising an upper portion and a lower portion which is disposed in adjacent relationship above the ingot mould, said feeder head being in overhanging relationship relative to the inside wall of the ingot mould;

the ingot mould is supplied with molten metal from the feeder head;

a mass of metal is maintained in the ingot mould in such a way, by a flow of cooling fluid on the outside of the ingot mould and on the metal, to cause solidification of the mass which is sufficient to permit extraction of the metal by way of the bottom, in a form corresponding to that of the ingot mould.

The process is characterised in that an inert gas prssure is applied to the lower portion of the periphery of the feeder head throughout the casting operation.

Thus, unlike the prior art, that process has no recourse to continuous lubrication and the injection of gas is not effected either at the level of the ingot mould or directly within the ingot mould, but at the level of the feeder head or hot-top and on the outside thereof.

It was surprisingly found that such a process resulted in billets which have a very good surface appearance and that it was only necessary to eliminate the gas pressure for the surface condition of the billets to suffer serious degradation.

It is though that the inert gas prevents the penetration of ambient air at the level of the lower portion of the feeder head.

In support of that hypothesis, it may be pointed out that the absence of inert gas causes the appearance of microporosities and pits or holes at the surface of the cast product, which seem to be due to oxidation of the metal by the moisture in the air, in the course of which reaction bubbles of hydrogen are formed in contact with the metal and constitute the source of the microporosities and the pits or holes.

This invention has the tremendous advantage of only requiring very simple means.

In fact, in U.S. Pat. No. 4,157,728, it is necessary to maintain a sufficient gas pressure to separate the metal from the wall without thereby giving rise to substantial movements within the molten metal, and that requires relatively sophisticated pressure control arrangements, in particular when the process involves multiple casting.

In contrast, in our process, it is sufficient to provide a minimum pressure which is just adequate to maintain the peripheral surface of the feeder head protected from the atmosphere.

The maximum acceptable pressure is determined by the value beyond which the gas would pass through the pores in the feeder head to such a substantial degree that the eddies or movements at the free surface of the metal would result in defective products. By virtue of the screening means formed by the feeder head bewteen the gas and the metal, that maximum pressure is relatively high. Therefore, there is a very wide control range between the minimum pressure and the maximum pressure and accordingly the process does not require any complicated control arrangement: the inert gas pressure is fixed once and for all by means of a simple tap and a pressure gauge-relief valve arrangement at a single point for the whole of the installation and does not require any readjustment in the course of a casting operation or between successive casting operations.

Such a process can be carried out in an apparatus which is of a simple construction such as for example that which is also subject-matter of the present invention and which comprises, as in the prior art:

an ingot mould having a movable bottom, provided on the outside with means for a feed of a cooling fluid and on the inside with a graphite ring, a feeder head which is disposed in adjacent and overhanging relationship above the ingot mould and which is clamped against the upper face of said ingot mould.

The apparatus is characterised in that:

the feeder head is composed of two portions which are connected to each other by way of a seal;

the lower portion of said feeder head is surrounded over the whole of its periphery by a ring which isolates it from the atmosphere and in respect of which the inside diameter is greater than the largest outside diameter of said portion so as to form an annular chamber around said portion and over at least a fraction of the height thereof; and said chamber is in relation to a source of gas under pressure by way of a feed conduit.

In that apparatus, the components are assembled in the following manner:

The lower feeder head rests on a shoulder with which the upper portion of the ingot mould is provided;

a clamping ring rests on the outside surface of said feeder head;

said assembly is applied against a base plate and the upper feeder head by way of a seal and at least six clamping nuts which are distributed around the entire periphery of the ingot mould.

In the course of the clamping operation, the nuts also contribute to causing the clamping ring to bear against the lower feeder head and thus contribute to subjecting it to a stress which increases in proportion to an increasing level of clamping action of the nuts.

However such an arrangement suffers from a number of disadvantages:

when the ingot mould is to be removed and then reassembled, in particular in order to go from one size of billet to another, it is necessary to remove each of the nuts, which takes up time and adversely affects maintenance costs;

each of the components, namely the ingot mould, the lower feeder head and the clamping ring, is separated from the others and the lower feeder head of refractory material which is thus abruptly freed of any stress thereon deteriorates so that it is necessary to provide for replacement thereof, which also has an adverse effect on maintenance costs.

It is for that reason that the present applicants, wishing to remedy those aspects, developed an improved apparatus characterised in that the clamping ring is provided with an edge portion which is fixed on a shoulder disposed in the upper portion of the ingot mould by means of screws and that said ingot mould is fixed with respect to the base plate by at least four springs which are in diametrally opposed relationship in twos and which are fixed with respect to a clamping bar.

Unlike the preceding apparatus, this forms an assembly comprising the lower feeder head, the ingot mould and the clamping ring, which can be separated as a unit from the base plate. That form of assembly also makes it possible to maintain the pressure stress applied to the lower feeder head, at a constant value which is independent of the clamping action for fixing the ingot mould to the base plate.

That assembly is easily integrated into the apparatus: it is applied against the base plate and the upper portion of the feeder head by way of a seal and it is held in that position by means of resilient blade members. The length of the periods of time for dismantling and reassembly is thus shortened.

Figure 3:
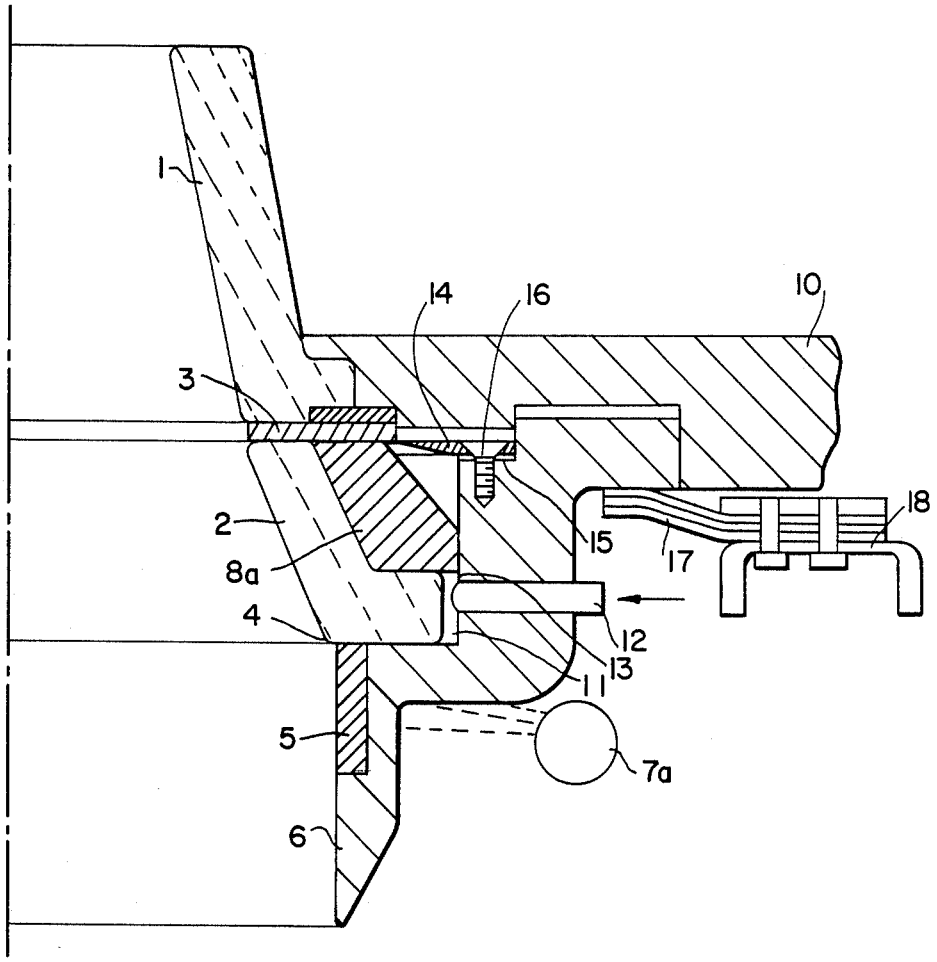

The invention will be better appreciated by reference to FIGS. 1 and 3 which show a view in section along a vertical line of half of the casting apparatus.

Referring to FIG. 1, shown therein is a feeder head or hot-top made up of an upper portion 1 connected to a lower portion 2 by way of a seal 3. The portion 2 is disposed in overhanging relationship at 4 in relation to the graphite ring 5 of the ingot mould 6, which is cooled externally by the cooling fluid issuing from *7a*. That assembly is held in fixed relationship by way of a clamping ring 8 and nuts 9 which fix the ingot mould to a base plate 10. The bottom of the portion 2 is surrounded over its entire periphery by a ring 13 so as to form an annular chamber 11 which is fed with inert gas by way of a conduit 12.

Figure 2:
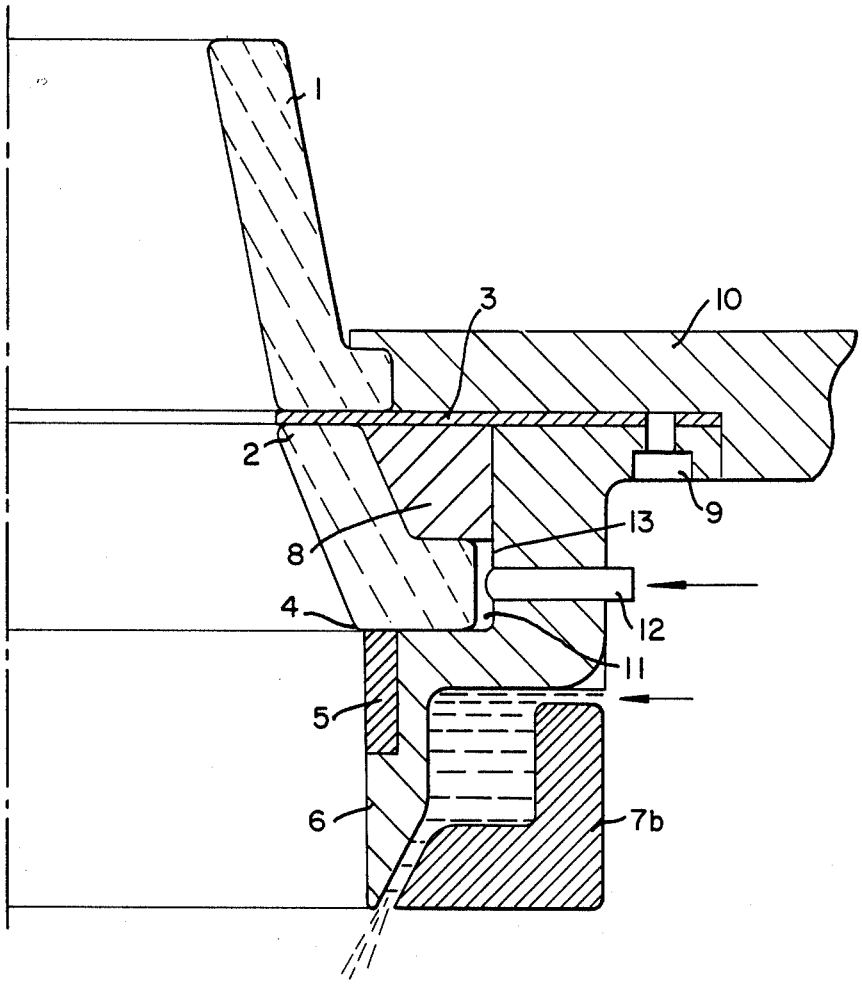

FIG. 2 differs from FIG. 1 in that the ingot mould is cooled by means of a system *7b*, which is generally referred to as a water jacket.

It is noted herein that the ring is formed by a portion of the ingot mould, which corresponds to a particular embodiment of the invention as that ring may be separate from the ingot mould.

FIG. 3 relates to the improved apparatus, and shown therein are the following:

an ingot mould 6 having a movable bottom, equipped on the outside with means *7a* for a feed of a cooling fluid and on the inside with a graphite ring 5;

a feeder head which is disposed in an adjacent position and in overhanging relationship at 4 above the ingot mould and which is clamped against the upper face of the ingot mould, made up of two portions 1 and 2 which are connected together by way of a seal 3, in which the lower portion 2 is surrounded over its entire periphery by a ring 13 which isolates it from the atmosphere and in which the outside diameter is larger than the largest outside diameter of said portion so as to form an annular chamber 11 around said portion and over at least a fraction of the height thereof, said chamber being in communication with a source of gas under pressure by way of a feed conduit 12.

The clamping ring 8a is provided with an edge portion 14 which is fixed on a shoulder 15 disposed in the upper portion of the ingot mould 6 by means of screws 16, and the ingot mould is fixed with respect to the base plate 10 by the pressure of at least four springs 17 which are disposed in diametrally opposite realtionship, in twos, and fixed with respect to the clamping bar 18.

Dismantling and reassembly of such an apparatus requires close to fifteeen times less time than in regard to an apparatus of the prior art. In addition, the amount of replacement of the feeder heads due to dismantling is virtually zero.

The invention may be illustrated by means of the following example of use thereof:

Two billets of aluminium alloy of type 6063 using the standards of the Aluminium Association were cast in an ingot mould which was cooled externally with water, of a diameter $\phi$ of 20 cm and a height h of 3.6 cm, fitted with a graphite ring of a height h of 2.6 cm, the lower portion of the feeder head being of a material formed by calcium silicate, with fibre reinforcement, which is commercially referred to as monalite, while the upper portion was of a product based on silica and hydraulic binding agent, referred to as glass-rock concrete.

In a first test, the gas feed conduit was in communication with the air.

In a second test, the conduit was connected to a source of dry nitrogen so as to maintain a pressure of 0.024 MPa while the other casting parameters were maintained identical to those of the first test. It was found that the billet obtained in the course of the first test had many pits or holes at its surface while that produced in the second test was entirely free therefrom.

By virtue of their simplicity, the process and the apparatus according to the invention can be used in particular in installations involving multiple ingot moulds for casting billets with a reduced labour force and without any danger of loss of adjustment.

We claim:

1. A process for the continuous casting of molten metal in an ingot mould having a movable bottom, which is internally provided with a graphite ring, which is externally cooled and having a wall in contact with the metal which is initially lubricated, comprising the steps of:

storing the molten metal in a feeder head comprising an upper portion (1) and a lower portion (2) which is disposed in adjacent relationship above the ingot mould (6), said feeder head having an overhang (4) with repsect to the inside wall of the ingot mould, feeding the ingot mould with molten metal from the feeder head, and maintaining a mass of metal on the ingot mould so as to cause, by a flow of cooling fluid on the outside of the ingot mould and on the metal, solidification of the mass which is sufficient to permit metal to be extracted by way of the bottom, in a form corresponding to that of the ingot mould, and further comprising applying an inert gas pressure to the periphery of the lower portion of the feeder head throughout the duration of the casting operation.

2. A process according to claim 1 characterised in that the pressure is sufficient to maintain the periphery protected fromm the atmosphere without exceeding the value above which the gas would give rise to movements at the surface of the mass of metal, which would be prejudicial to the surface condition.

3. Metal casting apparatus comprising:

an ingot mould (6) having a movable bottom and provided on the outside with means (7) for a feed of a cooling fluid, and on the inside with a graphite ring (5), a feeder head disposed in adjacent and overhanging relationship above the ingot mould and clamped against the upper face of said ingot mould, wherein the feeder head comprises an upper portion (1) and a lower portion (2) which are connected together by way of a seal, the lower portion (2) being surrounded over its entire periphery by a clamping ring (8) and by ring (13) which isolates the lower portion from the atmosphere, the diameter of said isolating ring being greater than the largest outside diameter of said lower portion, so as to form an annular chamber (11) around said lower portion, over at least a fraction of the height thereof, and wherein said chamber is in communication with a source of inert gas under pressure by way of a feed conduit (12).

4. A metal casting apparatus according to Claim 3, additionally comprising a base plate (10) and means for fixing said ingot mold with respect to said base plate comprising at least two pairs of springs in diametrically opposed relationship, each pair fixed to a clamping bar (18), wherein said clamping ring is provided with an edge portion (14) which is fixed on a shoulder (15) disposed in the upper portion of the ingot mold by means of screws (16), whereby assembly and dismantling of the apparatus is facilitated.

* * * * *